United States Patent [19]

Furlong

[11] Patent Number: 4,481,017

[45] Date of Patent: Nov. 6, 1984

[54] ELECTRICAL PRECIPITATION APPARATUS AND METHOD

[75] Inventor: Dale A. Furlong, Roanoke, Va.

[73] Assignee: ETS, Inc., Roanoke, Va.

[21] Appl. No.: 458,055

[22] Filed: Jan. 14, 1983

[51] Int. Cl.[3] ..... B03C 3/47; B03C 3/49; B03C 3/80

[52] U.S. Cl. ..... 55/12; 55/117; 55/130; 55/137; 55/138; 55/145; 55/154; 55/155

[58] Field of Search ..... 55/12, 117, 131, 137, 55/138, 154, 2, 130, 136, 143, 145, 155

[56] References Cited

U.S. PATENT DOCUMENTS

| | | | |
|---|---|---|---|
| 2,192,250 | 3/1940 | White | 55/131 X |
| 2,275,001 | 3/1942 | Anderson | 55/317 X |
| 2,395,927 | 3/1946 | White | 55/137 X |
| 3,154,682 | 10/1964 | Hartz et al. | 55/131 X |
| 3,733,784 | 5/1973 | Anderson et al. | 55/138 X |
| 3,910,779 | 10/1975 | Penney | 55/131 X |
| 3,915,676 | 10/1975 | Reed et al. | 55/131 X |
| 3,930,815 | 1/1976 | Masuda | 55/131 X |
| 4,313,739 | 2/1982 | Douglas-Hamilton | 55/131 X |

*Primary Examiner*—Kathleen J. Prunner
*Attorney, Agent, or Firm*—Bacon & Thomas

[57] ABSTRACT

An electrostatic precipitator having improved collection efficiency for suspended particles having either high or low electrical resistivities is provided. The precipitator utilizes porous collecting surfaces which permit passage of gas while retaining suspended particles and means are provided to create an electrostatic field causing the particles to migrate toward the collecting surfaces. According to the invention, only a portion of the inlet gas flow to the precipitator, sufficient to provide aerodynamic forces to facilitate adherence of the particles to the collecting surface, is drawn through the porous collecting surfaces with the remainder of the gas flow being essentially parallel to such surfaces. The two gas streams are separately withdrawn and may be combined to provide a clean gas effluent. The invention also provides an improved method for removing suspended particles from gases by electrical precipitation.

23 Claims, 6 Drawing Figures

FIG 1
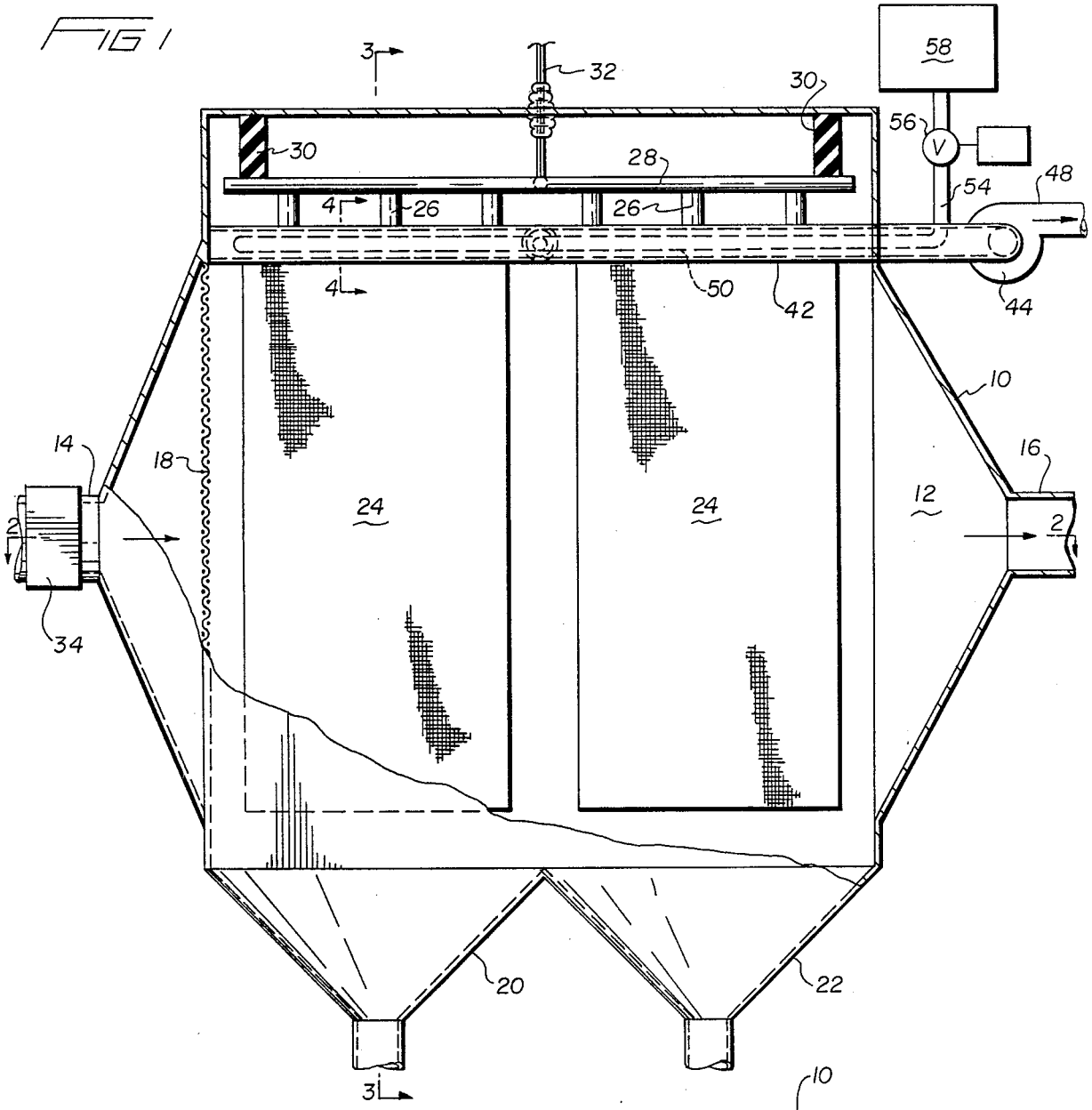
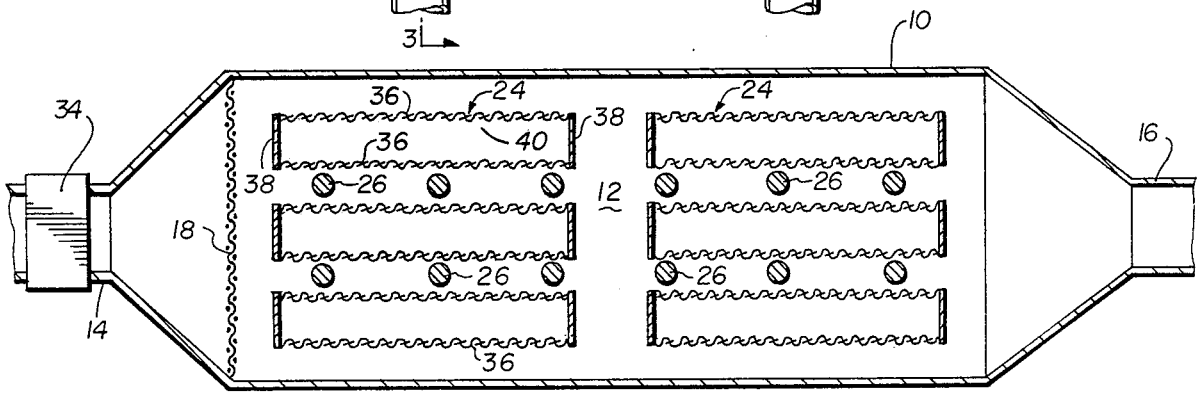
FIG 2

ELECTRICAL PRECIPITATION APPARATUS AND METHOD

BACKGROUND OF THE INVENTION

1. Field of the Invention

This invention relates to electrostatic precipitation and, in particular, to an improved electrostatic precipitation apparatus and method for removing suspended particles from gases whereby the efficiency of particle removal is improved and particle re-entrainment in the effluent gases is reduced.

2. Description of the Prior Art

Conventional duct type electrical precipitators for removing suspended particles from gases are provided with collecting plates on which suspended particles are precipitated due to action of an electrical field as the gases flow past the plates. It is known in the art to provide the collecting plates with openings so that the particles attracted to the plates can pass through the openings and be collected in the relatively dead space on the other side. U.S. Pat. No. 1,926,025 is representative of a device of this type. It has also been proposed to withdraw some gas through the collecting plate openings in an effort to keep the openings in the plates from clogging up. U.S. Pat. No. 1,769,338 discloses this concept. Other proposals have included combinations of electrical precipitation and bag type filters in which the fabric of the collector bag may be of electrically conductive material. In this type of system all of the gas is passed through the fabric and the particles are filtered out on one surface of the fabric. U.S. Pat. No. 3,839,185 is representative of such system. Each of these systems has attendant problems.

In the non-filter collector plate type electrical precipitator, particle re-entrainment has been a major problem.

Particles once captured on the collector plate do not necessarily remain captured. Solid particles are, in many cases, only lightly held to the electrode surfaces and can be easily dislodged by the windage effect of the gas flowing through the precipitator. This re-entrainment of precipitated particles is referred to as erosion. The term erosion usually includes all ways by which collected material can be lost through re-entrainment due to gas motion. The most important erosion effects are:

1. Direct scouring action of the gas on the collected dust on the electrodes,
2. Carry-through by windage of dust falling from the electrodes, this dust being initially loosened by its own weight or by rapping of the electrodes.
3. Sweepage of dust directly from hoppers caused by poor gas flow conditions or by air ingress into hoppers.

Erosion in precipitators is usually a combination of these three effects. The gas velocity itself is, however, the most important consideration and erosion is usually found to set in rather suddenly as precipitator gas velocity is increased. Erosion is a function of the dust being precipitated, of the configuration of the collecting electrodes, of the gas velocity distribution in the precipitator, and of the degree of turbulence and eddying of the gas in the precipitator.

Dust loss due to erosion can be visually observed or monitored with a photoelectric smoke-density recorder. Considerable "puffing" is usually observed at high boiler loads. "Puffing" is the phenomenon whereby the precipitator loss is irregular in nature being quite light at one instant and quite heavy a fraction of a second later, i.e., the ash loss appears to be concentrated in sporadic bursts lasting from a fraction of a second up to a few seconds.

Particle loss by re-entrainment is one of the most severe and oft recurring limitations present in the electrostatic precipitation of dry particles. Reentrainment is especially important when one considers the requirements of modern high efficiency precipitators where the loss of only a few percent of collected particles is sufficient to spoil performance.

The fundamental precipitator factors which may either cause or prevent re-entrainment include gas velocity and measures to insure uniform, low turbulence gas flow. Light, fluffy particles which are easily re-entrained and settle slowly in the gas generally limit gas velocities to a maximum of three to five feet per second. On the other hand, particles which form dense, compact layers on the collecting electrodes may be collected at much higher gas velocities of 10 ft./sec. to 15 ft./second. However, with poor gas flow conditions, these precipitation velocities may have to be reduced by a factor of two.

Re-entrainment is sensitive to corona voltage and current, as well as to voltage wave shape and precipitator sparking. Many industrial dispersoids have electrical resistivities in the bulk collected state of the order of $10^8$ ohm-cm to $10^{10}$ ohm-cm, which is sufficiently high to cause substantial attraction forces to the collecting electrode when permeated by the corona current, although not high enough to induce back corona. Under these conditions, the adhesion of the collected particle layers is greatly enhanced by the flow of strong and well distributed corona currents through the layers.

The magnitude of this electrical attractive force depends on the particle resistivity and the corona current density. The dust experiences a force proportional to the electric field strength, which in turn is proportional to the corona current and to the dust resistivity. Thus, the binding force increases both with resistivity and with current density, so that the resistivities which approach the critical value of about $10^{10}$ ohm-cm are helpful in holding the collected particles.

Precipitator sparking produces particle resuspension in two ways. First, the corona currents are interrupted for the small fraction of a second during which the spark occurs and some small portion of the collection is lost. Second, the spark itself locally disrupts the dust layer on the electrode and literally forms a small "bomb crater" and a local dust explosion. At high sparking rates these effects are multiplied many times per minute, and resultant dust resuspension becomes serious.

Rapping clearly may have a profound effect on re-entrainment. Excessive rapping tends to re-entrain all of the dust collected, and insufficient rapping leads to heavy dust buildup on the plates with resultant poor electrical operation and large re-entrainment losses.

Particles of low resistivity are especially vulnerable to re-entrainment because the corona-current binding forces are non-existent or even negative. Such particles may be actually repelled from the collecting surface owing to the pith-ball effect. The repulsive effect is very noticeable in the case of gritty particles which originate from poor combustion of the pulverized coal. These particles are relatively large, typically 100$\mu$to 200μ, and have low density, and low resistivity of the order of $10^4$ ohm-cm.

Particle deposits on the collection surfaces of a conventional precipitator must possess at least a small degree of electrical conductivity in order to conduct the ionic currents from the corona discharge to ground. The minimum conductivity required as shown both by theory and experience is about $10^{-10}$ inverse ohm-cm. Particles having conductivities less than the critical value of $10^{-10}$ are referred to as high resistivity particles, the critical minimum value of resistivity being about $10^{10}$ ohm-cm.

In precipitator operation high particle resistivity is usually manifested by disturbed electrical conditions in the form of excessive sparking at moderately lowered voltages or by excessive current at greatly lowered voltages. These effects in turn cause loss of precipitator efficiency, the loss in performance increasing with resistivity. When resistivity exceeds about $10^{11}$ ohm-cm, it becomes very difficult to achieve reasonable efficiencies with precipitators of conventional design. Special types of precipitators must then be used or measures taken to reduce resistivity.

Fly ash collection comprises more than half of the total precipitator installations in terms of gas treated. Fly ash is a generic term used to designate the particulate matter carried in suspension by the effluent or waste gases from furnaces burning fossil fuels. In modern usage, the term usually refers to the particulate omission from the burning of pulverized coal. The character and properties of the ash, including resistivity, vary widely with such factors as the coal burned, design and operation of the furnace, and the steaming rate of the boiler. Not only may the ash differ greatly from plant to plant, but may also very from day to day in a given plant.

Major constituents of most fly ashes are silica, alumina, and iron oxide. The first two are present primarily as silicates, which give fly ash particles their typical glassy appearance. Carbon may also be a major constituent of some fly ashes, ranging from a fraction of a percent for good combustion up to 40% or even 50% for very poor combustion. A carbon content of about 10% or greater usually is sufficient to ensure low resistivity of the ash. There is also a water soluble portion of fly ash which, although usually only a few percent or less, is of great importance in determining the electrical conductivity of the particles.

Measurements made on many fly ashes under actual field conditions show normal values of resistivity below the critical value of about $10^{10}$ ohm-cm, some in the marginal zone between $2\times10^{10}$ ohm-cm and $5\times10^{10}$ ohm-cm where precipitator trouble is probable and a few in the region about $5\times10^{10}$ ohm-cm where trouble is certain. Inasmuch as the moisture content of practically all boiler gases lies in a narrow range of 6% to 9%, it is evident that moisture is only a minor factor in the wide variations observed for fly ash resistivity. Carbon is also a minor factor for the great majority of fly ashes.

Back corona is the descriptive term for the local discharge from the normally passive electrode in a corona-discharge system when the electrode is covered with a poorly conducting dust or fume. Under suitable conditions of corona voltage and current, the layer breaks down locally and a small hole or crater is formed from which a visible back corona discharge occurs. Such discharges reduce precipitator collection efficiency by lowering sparkover voltage and by producing positive ions, which decrease particle charging.

In a corona discharge system with a dust layer deposited on the passive electrode, if the dust is a good conductor, there is little or no disturbance of the corona discharge. However, as the dust conductivity is decreased, a point is reached where the corona ions begin to be impeded by the resistance of the layer. This causes the voltage to increase across the layer and to correspondingly decrease across the gas, with the result that the corona current falls somewhat. As the dust conductivity is further reduced, the voltage across the layer continues to increase and finally causes dielectric breakdown of the layer. This is the onset point of the back corona discharge. Depending on conditions, the localized breakdown of the dust layer may either propagate across the corona gap and thus cause a spark, or remain localized and form a stable back corona crater. Stable back corona is marked by the appearance of one or more blue colored local discharges on the dust layer. In severe cases, the dust layer will be covered with literally hundreds or thousands of such glow points per square foot. The corona at the wire then becomes concentrated into a relatively few intense stationary brushes of somewhat white appearance, and the corona current rises to several times the normal current. Formation of back corona craters is especially favored by thin dust layers and high resistivity dust. Severe back corona has been observed with dust layers as thin as 0.1 mm, but a dust layer a little over one particle thick can reduce the sparking voltage by 50%.

Development of practical means for overcoming or circumventing high resistivity effects in electrical precipitation has long been a major goal. Early endeavors used moisture and acid conditioning. Earlier investigators also tried brute force methods including moving belt electrodes, rotating brushes, and various other gadgetries. These were uniformly unsuccessful not only because of the troublesome mechanical problems introduced, but also because most of the schemes are unsound, in that even thin films of dust can produce severe back corona effect.

High resistivity problems may be avoided by the use of water flushed or wet film collecting electrodes. The wet film principle has been applied successfully on a pilot scale to two stage precipitators in which the water film is used only in the charging section and the collector section operates dry. Dusts have resistivities as high as $10^{12}$ or $10^{13}$ ohm-cm have been collected at high efficiency by this method in test units of 1000-cfm or 2000-cfm capacity. However, the problems of maintaining the water films over long periods of time have prevented large scale use of this method so far.

Another approach which has been effective in laboratory tests is based on temperature control of the collecting electrodes. Either cooling or heating may be used to shift the electrode temperature out of the critical intermediate range near the peak of the resistivity curve. Heating a large electrode surface to the required high temperature region necessitates large amounts of power; on the other hand, cooling the electrode may well result in condensation and fouling of the electrode surface by wet dust deposits.

More recent work has included the use of chemical additives to adjust the resistivity of the collected dust. Some success has been demonstrated, however, the variabilities of fly ash characteristics as previously noted and the economics of additives have limited the widespread use of this approach.

SUMMARY OF THE INVENTION

The objective of the present invention is to provide an electrostatic precipitator and method having improved collection efficiency and minimal re-entrainment problems for dusts having either high or low electrical resistivities. This objective is accomplished by providing a precipitator having a porous collecting surface, using fabrics such as are used in fabric filters or other porous material pervious to gas flow and substantially impervious to passage of solid particles, and drawing a minor portion (typically less than 20%) of the dirty gas stream through the collected dust cake and the porous collecting surface while passing the major part of the gas stream through the precipitator without passage through the filter. The small portion of the total stream is, of course, filtered and can then be added to the precipitator outlet flow, but more importantly in accomplishing the previously stated objective, this portion of the total flow provides an aerodynamic force to reduce re-entrainment of the dust cake collected on the filter plate. Dust is then removed from the collecting filter by conventional filter cleaning techniques such as pulse cleaning, reverse air cleaning, shake cleaning, or a combination of these.

To appreciate the potential of the dust filter cake aerodynamic force in reducing re-entrainment, consider the following typical values. For an electrostatic precipitator average through-put velocity of 6 ft./sec., and a fabric filter pressure drop across the dust cake of 4 inches of water, the retaining force, i.e., the cake pressure drop, is approximately 400 times as large as the re-entraining force, i.e., the dynamic head of the flowing stream.

The provision of a significant aerodynamic force to counteract re-entrainment has at least two benefits:

1. Higher through-put velocities may be used and/or less dependence on maintaining uniform velocities throughout the precipitator.
2. The need of maintaining an appropriate corona current through the dust cake for dust retention is replaced by the pressure drop force. Elimination of the need for corona current in the cake in turn eliminates the dependency of the process on dust resistivity, either high or low. Corona current can be eliminated in the collector by using a dust precharger, together with a non-corona collecting electric field.

DESCRIPTION OF THE INVENTION

The invention will be further understood by reference to the accompanying drawings, in which:

FIG. 1 is a side elevational view, partially cut away for purposes of illustration, of one embodiment of an eletrical precipitator utilizing the principles of the invention.

FIG. 2 is a horizontal sectional view of the precipitator shown in FIG. 1 taken along the lines 2—2 of FIG. 1.

Figure 3:
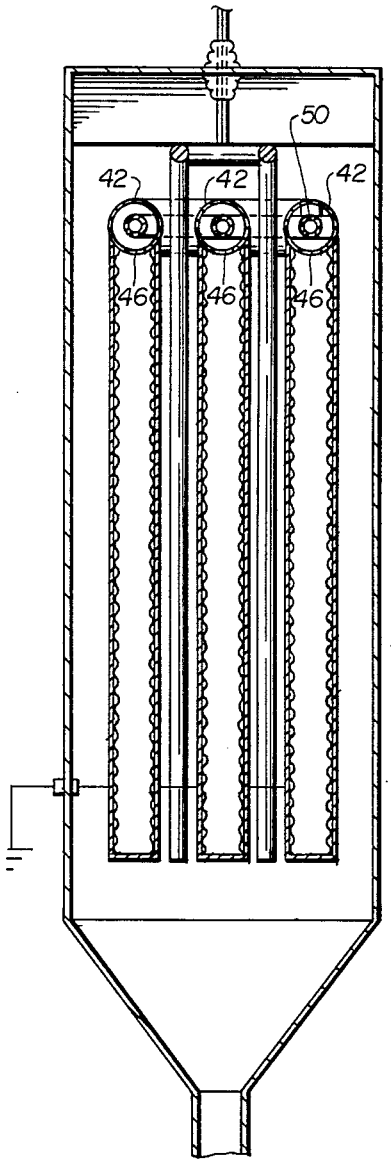
FIG. 3 is a vertical sectional view of the precipitator of FIG. 1 taken along the lines 3—3 of FIG. 1.

Referring now to the embodiment of the invention as shown in FIGS. 1-4 of the drawings, there is shown an electrical precipitator housing 10 enclosing a chamber 12 and being provided with an inlet 14 for dirty gases and an outlet 16 for clean gases. A gas distributing screen, or the like, 18 is provided at the inlet end of the precipitator and hoppers 20 and 22 are provided for collection and removal of accumulated solid particles. This structure so far is of a conventional nature and is well known in the electrical precipitator art.

Within the chamber 12 of the precipitator, there are suspended a plurality of collector plates 24 interspersed by a plurality of electrodes 26. The electrodes 26 are suspended from a grid 28 mounted within the top of the chamber by electrically insulating means 30 and provided with a source of high voltage electricity by line 32, all in known manner. The electrodes 26 are of relatively large tubular configuration without points, projections or other irregularities which would initiate a corona discharge resulting from ionization of surrounding gases. A pre-charger 34 located just ahead of the inlet 14 of the precipitator is provided in order to give the incoming particulate an electrostatic charge. This pre-charger may be provided with ionizing electrodes in a manner well known in the art. In this embodiment the device would act as a two-stage collector using the pre-charger 34 to give the incoming particulate an electrostatic charge. However, it will be understood that the electrodes 26 could be provided with means whereby they can act both as ionization electrodes and polarization electrodes without departing from the broader scope of the present invention.

The collecting electrode plates 24 as shown in FIGS. 1-3, comprise opposed relatively flat walls 36 which are held apart by end walls 38 and supporting grids 40 of electrically conductive material. The walls 36 may be made of conventional fabric filter cloth or other material which is pervious to gas flow but substantially impervious to passage of solid particles. Alternatively, in lieu of the electrically conductive supporting grids 40, the walls 36 may be made of electrically conductive material or of a material which has been treated to obtain conductive properties. The walls 36 and/or grids 40 are electrically grounded by connection with the metal wall of the precipitator as will be apparent from the following description.

The collecting plates 24 as shown in FIGS. 1-3 are essentially an envelope of fabric, either self-supporting or with supporting cage to prevent collapsing. The envelopes are closed at the bottom and the space within the envelope is connected to a means for withdrawing gas as will be further described below. The thickness of each fabric plate collecting electrode or envelope in this configuration may be as little as one inch provided there is adequate flow space for the gas to be pulled through the filter surface.

As shown in FIGS. 1 and 3, the collecting electrode plates 24 are supported at their top ends by pipes 42 which are connected outside of the precipitator to a suction fan 44. The pipes 42 have openings or slots 46 along their bottom portions so as to provide communication between the interior of the collecting electrode envelopes and the suction fan 44. By this means, a desired portion of gases flowing through the precipitator between the inlet 14 and outlet 16 may be withdrawn through the collecting electrode filter walls to an outlet 48 which can be connected by means (not shown) to the main outlet 16 so as to re-combine the cleaned gases.

Pipes 42 contact the metal walls of the precipitator 10 and by this means provide an electrical ground for the collecting electrode plates 24.

Figure 4:
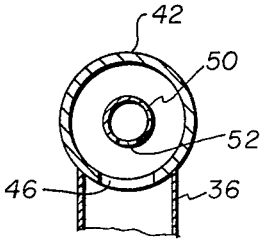
FIG. 4 is a fragmentary vertical sectional view taken along the lines 4—4 of FIG. 1.

Within the pipes 42, there are axially aligned smaller pipes 50 which are also provided with slots or openings 52 along their bottom portions (FIG. 4). Pipes 50 communicate by way of line 54 and control valve 56 to a reservoir 58 for compressed gases. By this means, a pulse jet of gases can be provided to clean the accumulated particles from the outer walls of the collecting electrode plates 24.

Table 1 below presents typical design parameters for this embodiment of the invention. A voltage of 20,000 to 50,000 volts is applied to the electrodes 26 in order to give a field strength in kilovolts per centimeter of 2 to 5. The reduction in re-entrainment losses and the increased collecting field provided by prevention of back corona permits sufficient collection efficiency at a specific collection area (SCA) of about 190. At a fabric plate flow velocity (gas-to-cloth ratio) of 1 foot per minute, 17% of the inlet gas flow is diverted through the fabric collecting plates. However, it will be understood that this diverted flow percentage can be reduced depending upon a number of factors, including variations of precipitator output velocities, provided adequate dust adhesion forces are obtained at the filter surface. Thus, the amount of gas withdrawn through the filter surfaces can be adjusted by the operator to suit overall conditions.

TABLE 1

| | |
|---|---|
| Fabric Plate Center-Line Spacing = | 9 inches |
| Fabric Plate Thickness = | 1 inch |
| Plate to Plate Spacing = | 8 inches |
| Fabric Plate Height = | 30 feet |
| Fabric Plate Depth = | 20 feet |
| Precipitator Through Velocity = | 6 ft./sec. |
| SCA* (CFM/1000 ft.$^2$) = | 190 |
| Precipitator Flow Per Passage = | 7200 CFM |
| Fabric Plate G/C** = | 1 ft./min. |
| Gas Flow Per Plate = | 1200 CFM |
| Required Plate Duct Diameter = | 8.5 inches |

*(SCA - Specific Collecting Area)
**(G/C - Volume Flow Per Cloth Area)

Figure 5:
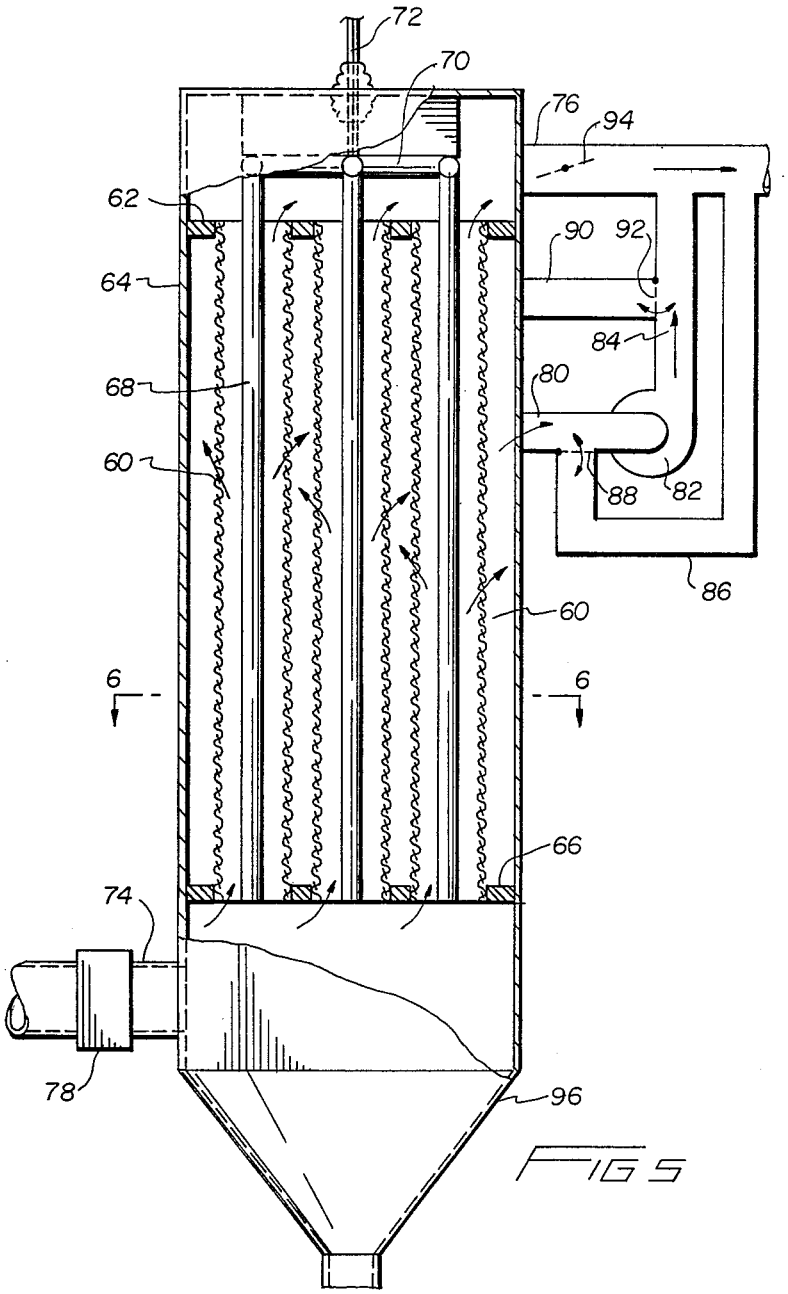
FIG. 5 is a side elevational view, partially cut away for purposes of illustration, of a further embodiment of an electrical precipitator utilizing the principles of the present invention.
Figure 6:
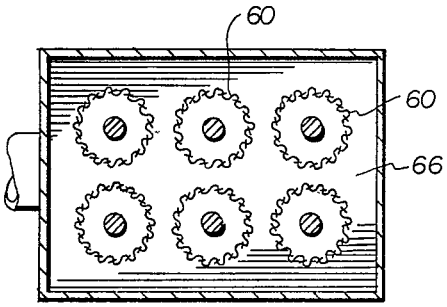
FIG. 6 is a horizontal cross-sectional view of the precipitator of FIG. 5 taken along the lines 6—6 of FIG. 5.

An alternative embodiment of the invention is shown in FIGS. 5 and 6. In this embodiment, a plurality of tubular bags 60 of gas pervious, particle impervious fabric or the like are used as the collecting electrodes. Electrical conductivity of the collecting surface may be provided by added conductive yarns in the axial direction of the fabric or by using filter bags of carbonized fabrics containing carbon fibers such as disclosed, for example, in U.S. Pat. No. 3,294,489. Alternatively, fabric bags of non-conductive material may be supported on electrically conducting grids as in the earlier described embodiment.

The bags 60 are supported at their top by a plate 62 of metal or other conductive material which is in contact with the metal walls 64 of the precipitator. The bottom ends of the bags 60 are likewise supported by a plate 66 of metal or other conductive material which is likewise in contact with the walls 64 of the precipitator.

An electrical field is provided by high voltage electrodes 68 which extend axially through the center of the bags. These electrodes 68 are supported by a grid 70 connected to a source of high voltage by means of line 72. The electrodes 68 as shown are of smooth configuration so as to minimize corona discharge. However, as aforestated, electrodes may be used which are designed to provide a corona discharge for particle ionization as well as polarization.

The precipitator shown in FIGS. 5 and 6 is provided with an inlet 74 for dirty gases and an outlet 76 for clean gases. A pre-charger 78 is provided at the inlet 74 for electrically charging the particles of the dirty gas in instances in which the electrodes 68 are used only for providing the electrostatic field necessary for causing the particles to migrate toward the walls of the collector bags 60.

In this embodiment dirty gases from the inlet 74 pass axially through the bags 60 and are cleaned by reason of the suspended particles migrating to the interior surfaces of the collecting bags 60. The major portion of the cleaned gases pass out of the top of the bags 60 and out through the outlet 76. A portion of the gases, e.g. less than about 20% of the total stream, is drawn through the porous surfaces of the bags 60 and exit by way of outlet pipe 80, fan 82 and pipe 84 which as shown connects with the outlet 76. By this means the two gas streams are recombined to provide a stream of clean gas.

A gas return conduit 86 connects main outlet conduit 76 back to line 80 at the intake of the suction fan 82. A valve 88 is shown at this juncture. A conduit 90 is provided between the outlet pipe 84 of fan 82 and the interior of the precipitator. The juncture of conduit 90 and conduit 84 is also provided with a valve 92 and a main outlet conduit 76 is provided with a valve 94. By proper manipulation of these valves, cleaning of the bags can be achieved by stopping the main flow of dirty gas then reversing the air flow through the bags resulting in bag flexing and removal of the collected dust from the interior of the bags which then drops by gravity (and the reverse air flow) into the dust hopper 96 located below the bags. In the drawing, FIG. 5, the valves 88, 92 and 94 are in position for cleaning the dirty gas entering through inlet 74 and exiting through outlets 76 and 80. During the cleaning cycle, valves 88 and 92 would be operated so that the flow of gas would be from conduit 76 through line 86, fan 82 and line 90 and thence through the bags 60 in a reverse direction so as to effect cleaning.

It will be understood that modifications such as will occur to those skilled in the art may be made without departing from the spirit and scope of the invention. For example, the filter surfaces of either embodiment may be cleaned by conventional fabric filter cleaning techniques such as pulse cleaning, reverse air cleaning, shake cleaning, or any combination of these. The electrode configurations, spacing and the like may be varied to provide high voltage single-stage as well as low voltage two-stage operation. The invention is characterized in that the partial withdrawing of gas through the filtering electrode surfaces improve adherence of the particles to the collecting surfaces and minimizes re-entrainment of the particles in the main gas stream. As aforestated, the invention may be used for improving collection efficiency for dust having either high or low electrical resistivities. The invention is limited in scope only as set forth in the appended claims.

What is claimed is:

1. In a method for the electrical precipitation of particles from gases wherein a gas stream containing said particles is passed through an enclosed contact zone having an electrostatic field causing said particles to migrate from the gas stream toward a collecting surface comprising a gas filter pervious to gas flow and substantially impervious to passage of solid particles on which said particles collect, the improvement comprising passing a portion of said gas stream through said enclosed contact zone without passage through said filter and withdrawing another portion of said stream through said filter to thereby facilitate adherence of the collected particles to the surface of said filter.

2. The method of claim 1 wherein said particles receive an electrical charge in said enclosed contact zone.

3. The method of claim 1 wherein said particles are given, an electrical charge prior to entering said enclosed contact zone.

4. The method of claim 1 wherein the portion of the gas stream withdrawn through the filter is a minor portion of the total gas stream.

5. The method of claim 4 wherein said minor portion is less than about 20% of the total gas stream.

6. The method of claim 1 wherein the portions of the gas stream are recombined downstream from said enclosed zone to provide a clean gas stream.

7. The method of claim 1 wherein the filter is cleaned of adhering particles by reversing the flow of gases through the filter.

8. An electrical precipitating apparatus comprising a chamber having an inlet and an outlet for flow of gases, said chamber having therein at least one collecting electrode comprising a filter pervious to gas flow and substantially impervious to passage of solid particles, means in said chamber for establishing an electrostatic field to cause particles suspended in said gases to migrate from said gases toward the surface of said collecting electrode, means for passing a portion of said gases through said chamber without passage through said filter and means for withdrawing another portion of said gases through said filter to facilitate adherence of said particles to the surface of said filter.

9. The apparatus of claim 8 wherein said filter comprises an electrically conducting fabric.

10. The apparatus of claim 8 wherein said filter comprises a non-conducting fabric mounted on an electrically conducting grid.

11. The apparatus of claim 8 wherein said collecting electrode comprises spaced filter walls providing an enclosure and said means for withdrawing a portion of said gases through said filter communicates with said enclosure.

12. The apparatus of claim 11 wherein said spaced filter walls provide substantially flat walls on opposite sides of said enclosure.

13. The apparatus of claim 12 wherein said spaced filter walls are of electrically conductive fabric.

14. The apparatus of claim 12 wherein said spaced filter walls are of non-conductive material supported by an electrically conducting grid.

15. The apparatus of claim 11 comprising a plurality of said collecting electrodes interspersed with said means in said chamber for establishing an electrostatic field, wherein said means in said chamber for establishing an electrostatic field is a plurality of electrodes for creating said electrostatic field.

16. The apparatus of claim 11 comprising a reservoir of compressed gases and means providing selective communication between the enclosure provided by the spaced filter walls and said reservoir to thereby provided for pulse jet cleaning of said walls.

17. The apparatus of claim 8 comprising means for reversing gas flow through said filter during a cleaning cycle.

18. The apparatus of claim 8 wherein said collecting electrode comprises a tubular fabric filter and said means for establishing an electrostatic field comprises an electrode axially positioned within said tubular fabric filter.

19. The apparatus of claim 18 wherein said means for passing a portion of said gases through said chamber without passage through said filter comprises means for passing said gases into one end of said tubular fabric filter and out of the other end of said filter and said means for withdrawing another portion of said gases through said filter comprise means for withdrawing gas from the chamber containing said tubular filter.

20. The apparatus of claim 19 comprising a plurality of said tubular fabric filters contained within said chamber.

21. The apparatus of claim 8 wherein the means for establishing said electrostatic field comprises at least one non-corona discharge electrode spaced from said collecting electrode.

22. The apparatus of claim 21 comprising pre-charge means connected to the inlet of said chamber for providing an electrical charge to particles suspended in said gases prior to their entry into said chamber.

23. The apparatus of claim 8 comprising means for recombining the portions of gases to provide a clean gas stream.

* * * * *